US007127763B1

(12) United States Patent
Schmid et al.

(10) Patent No.: US 7,127,763 B1
(45) Date of Patent: Oct. 31, 2006

(54) CRIB MATTRESS SAFETY FEATURES

(75) Inventors: William R. Schmid, Plymouth, MN (US); John Simon, Eagan, MN (US); Steven R. Kunert, Cedar Rapids, MN (US)

(73) Assignee: Halo Innovations, Inc., Plymouth, MN (US)

( * ) Notice: Subject to any disclaimer, the term of this patent is extended or adjusted under 35 U.S.C. 154(b) by 0 days.

(21) Appl. No.: 11/118,752

(22) Filed: Apr. 29, 2005

Related U.S. Application Data

(60) Provisional application No. 60/567,117, filed on Apr. 30, 2004.

(51) Int. Cl.
*A47C 21/04* (2006.01)
*A47D 7/00* (2006.01)

(52) U.S. Cl. ..... 5/726; 5/423; 5/692; 5/697

(58) Field of Classification Search ..... 5/726, 5/423, 692, 424, 724, 697, 725, 652.2
See application file for complete search history.

(56) References Cited

U.S. PATENT DOCUMENTS 1,246,544 A * 11/1917 Chassaing ..... 5/187
2,400,790 A * 5/1946 Tolen ..... 5/284
2,493,067 A * 1/1950 Goldsmith ..... 5/726
2,826,766 A * 3/1958 Stoner ..... 5/498
3,893,198 A * 7/1975 Blair ..... 5/699
5,063,625 A * 11/1991 Perry ..... 5/697
5,857,232 A * 1/1999 Mahdavi ..... 5/655
5,887,304 A * 3/1999 von der Heyde ..... 5/726
6,052,853 A 4/2000 Schmid
6,336,237 B1 * 1/2002 Schmid ..... 5/726

* cited by examiner

*Primary Examiner*—Alexander Grosz
(74) *Attorney, Agent, or Firm*—Hamre, Schumann, Mueller & Larson, P.C.

(57) ABSTRACT

Safety features for a crib mattress are described. One safety feature is designed to maintain airflow to a fan inlet despite the fan inlet being blocked by a mattress sheet. Another safety feature removes obstructions to airflow within the mattress so that air is dispersed more uniformly across the sleep surface which is formed by a taut sheet of fabric. Yet another safety feature is designed to help retain a fitted sheet on a mattress and make it difficult for the sheet to be inadvertently pulled off the mattress.

20 Claims, 7 Drawing Sheets

CRIB MATTRESS SAFETY FEATURES

This application claims the benefit of U.S. Provisional Application No. 60/567,117 filed on Apr. 30, 2004.

FIELD OF THE INVENTION

The invention relates to a crib mattress that has safety features incorporated into its design to reduce the risk of re-breathing carbon dioxide and reduce the risk of entanglement in a crib sheet.

BACKGROUND OF THE INVENTION

Carbon Dioxide ($CO_2$) that is accumulated and rebreathed in the bedding of prone sleeping infants is believed to be a contributing factor to an elevated risk of Sudden Infant Death Syndrome (SIDS) in these infants. One approach that is believed to prevent or reduce the occurrence of SIDS is to use a ventilated mattress in which an airflow is created through the mattress to dissipate carbon dioxide accumulation adjacent the infant's nose and mouth.

In addition, during sleep, an infant may tend to roll and move to different sleep positions. This can lead to the crib sheet or other bedding being pulled out of position, increasing the risk that the infant can become entangled in the crib sheet or be suffocated by the bedding. Further, disruption of the bedding can create pockets for $CO_2$ to accumulate.

The present invention relates to safety features that reduce the risk of re-breathing $CO_2$ and reduce the risk of entanglement in crib sheet bedding.

SUMMARY OF THE INVENTION

The invention relates to a ventilated crib mattress in which air is drawn into the mattress and then discharged through the upper surface of the mattress. The airflow helps to dissipate carbon dioxide accumulation adjacent the infant's nose and mouth when the infant is on the mattress.

The mattress is provided with features that reduce the risk of an infant re-breathing carbon dioxide and that reduce the risk of an infant becoming entangled in a crib sheet.

In one embodiment, the mattress includes a foundation, a sleep surface assembly and a fan assembly. The sleep surface assembly includes a frame, a sleep surface connected to the frame and a tensioning mechanism for adjusting the tension of the sleep surface.

DRAWINGS

DETAILED DESCRIPTION

The invention relates to a ventilated crib mattress in which air is drawn into the mattress and then discharged through the upper surface of the mattress. The airflow helps to dissipate carbon dioxide accumulation adjacent the infant's nose and mouth when the infant is on the mattress.

The mattress utilizes a fan to draw air through a filter on the floor of the mattress, which is then discharged into the interior of the mattress. Ribs 9 (FIG. 2) and feet 11 (FIG. 2) on the bottom of the mattress 6 allow air to be channeled to the air inlet or opening 10 (FIG. 2) of the fan and into the interior of the mattress. Some sheets used on the mattress, such as a sheet having deep pockets, may have a tendency to partially or completely cover the opening 10 when the sheet is placed on the mattress. If this happens, the air can still flow through the channels defined between the ribs 9 and into the opening 10. The air then flows from the interior plenum of the mattress gently through a porous sleep surface, thereby dispersing any carbon dioxide accumulating near the infant's face.

Because the air needs to disperse uniformly across the entire sleep surface it needs to move through the interior of the mattress unimpeded. Therefore, foam cannot be used to support the sleep surface. Additionally, using conventional innersprings for support would provide an irregular, uncomfortable profile through the porous fabric ideally suited for use as the sleep surface.

Figure 1:
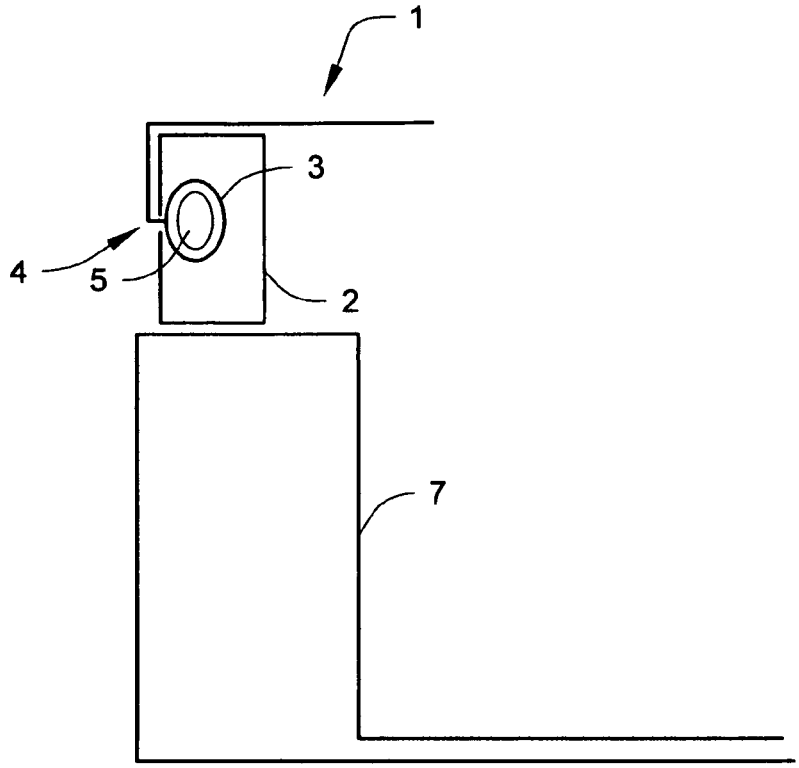
FIG. 1 is a cross-sectional view of a portion of a crib mattress detailing the concepts of one safety feature in accordance with the invention.

One solution, as shown in FIG. 1, is to stretch the porous fabric 1 taut over a frame 2 positioned on the top wall of a mattress foundation 7. To accomplish this you could start with a rectangular piece of fabric and sew a narrow pocket 3 around the fabrics perimeter. This pocket could be inserted into the rigid frame 2 which has a slot 4 on the outside of it. A dowel 5 could then be inserted into the fabric pocket 3 securing the fabric into the frame. Varying the diameter of the dowel and/or rotating the dowel within the slot 4 would allow the tension of the fabric to be varied to make the sleep surface firmer or softer.

The frame 2 is preferably removably positioned on the top wall of the foundation 7. Hook and loop fasteners could be used to detachably secure the frame 2 to the foundation 7. Alternatively, the frame 2 could simply rest on top of the foundation.

The dowel 5 is preferably inserted into the pocket 3 through an opening in an end of the frame section. The frame 2 has one frame section for each section of the foundation 7 on which it is disposed. Therefore, for a rectangular foundation 7, the frame 2 would have four frame sections. A dowel 5 would be used in each frame section to secure the fabric 1 as illustrated in FIG. 1.

Figure 2:
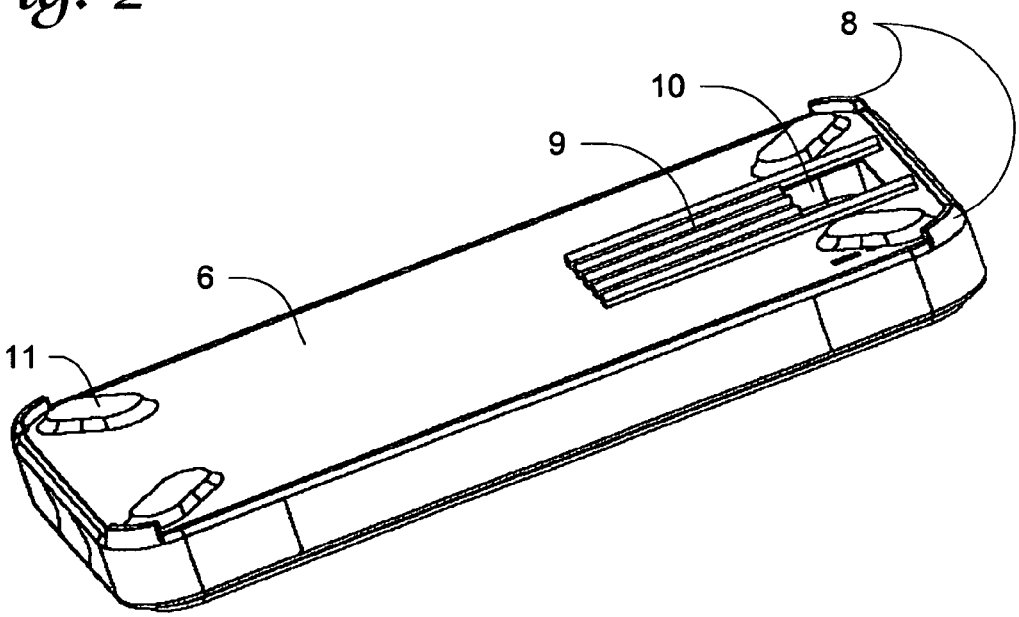
FIG. 2 is a perspective view of a bottom of a mattress illustrating the concepts of another safety feature in accordance with the invention.

Another safety feature, illustrated in FIG. 2, is found on the bottom of the mattress 6 where each corner would have a protrusion, or cleat 8, that makes it more difficult for a conventional fitted sheet or mattress pad to inadvertently be pulled off of the mattress corner when the infant is on it, which could lead to entanglement or suffocation. This sheet cleat 8, as shown in FIG. 2, protrudes from the mattress underside catching the fitted cuff of the sheet and pinching it with the weight of the mattress and baby against the crib floor. This feature could be used on adult and other non-infant mattresses as well.

Figure 3:
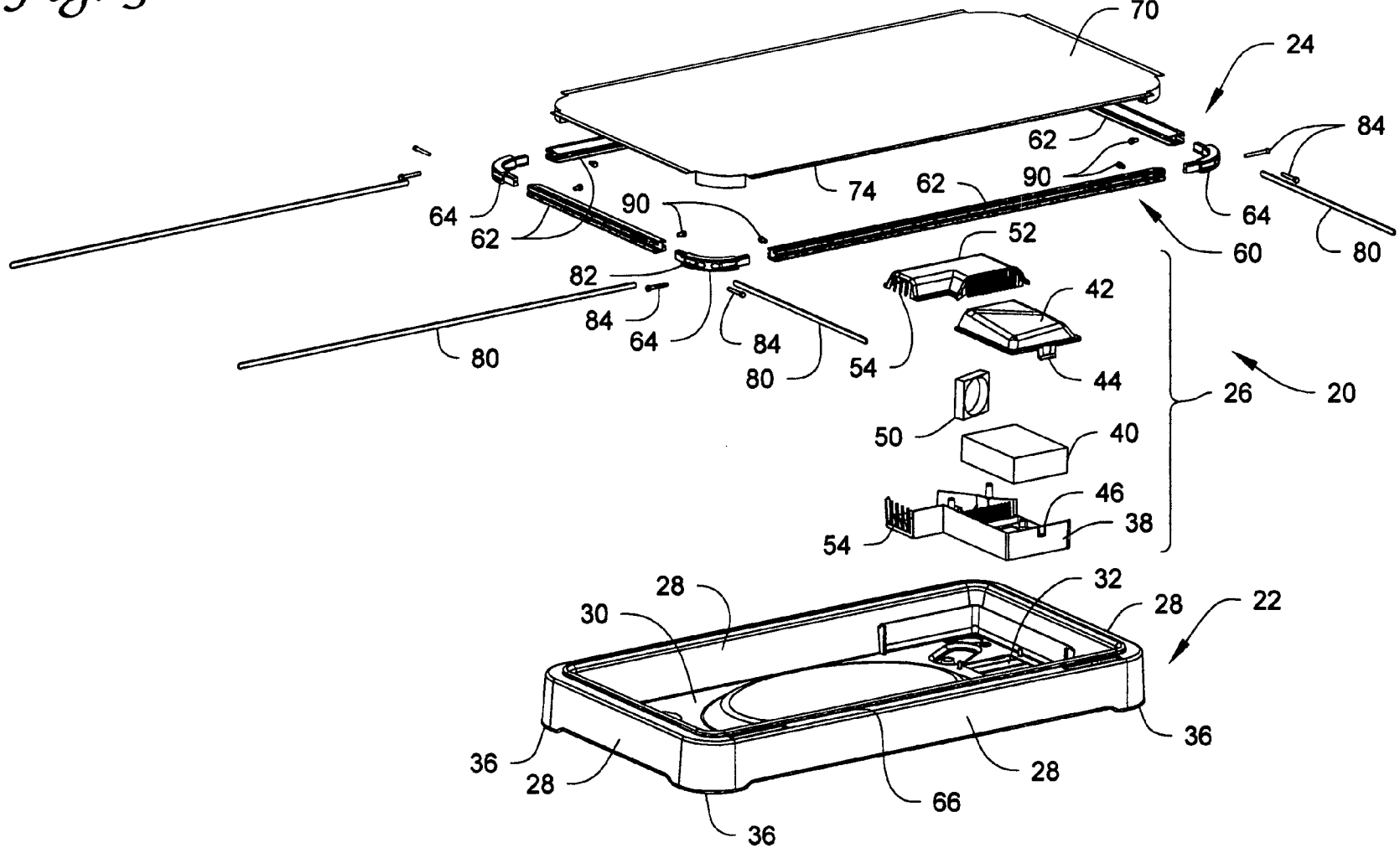
FIG. 3 is an exploded view of the components of a crib mattress in accordance with another embodiment of the invention.

FIG. 3 is an exploded view of the components of an alternative embodiment of a crib mattress 20. The mattress 20 includes a foundation 22, a sleep surface assembly 24 and a fan assembly 26.

The foundation 22 is generally rectangular in shape and comprises a generally rigid structure made of a suitable material, for example plastic. The foundation 22 includes four side walls 28 that extend upwardly from a bottom wall 30 to define a generally hollow interior. An air inlet or opening 32 is formed through the bottom wall 30 to permit entry of air into the interior via the fan assembly 26.

Figure 4:
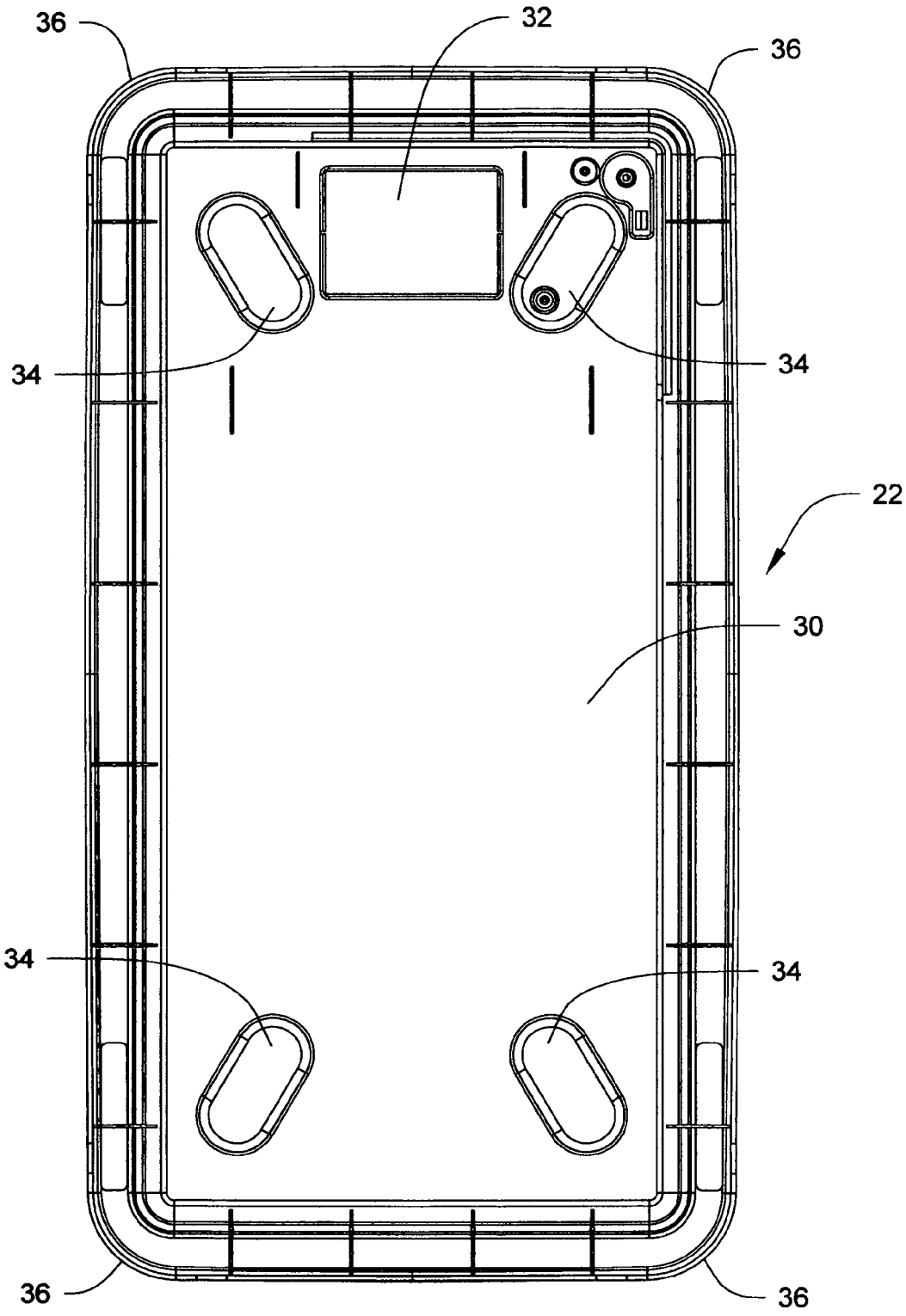
FIG. 4 is a bottom view of the mattress foundation of the crib mattress of FIG. 3.

With reference to FIG. 4, the bottom of the foundation 22 includes feet 34 that perform a function similar to the feet 11 in FIG. 2. Also, the foundation 22 includes cleats 36 at the four corners thereof that perform a function similar to the cleats 8 in FIG. 2. If desired, ribs, similar to the ribs 9 in FIG. 2, could be used on the bottom of the foundation 22 adjacent to the opening 32.

Figure 5:
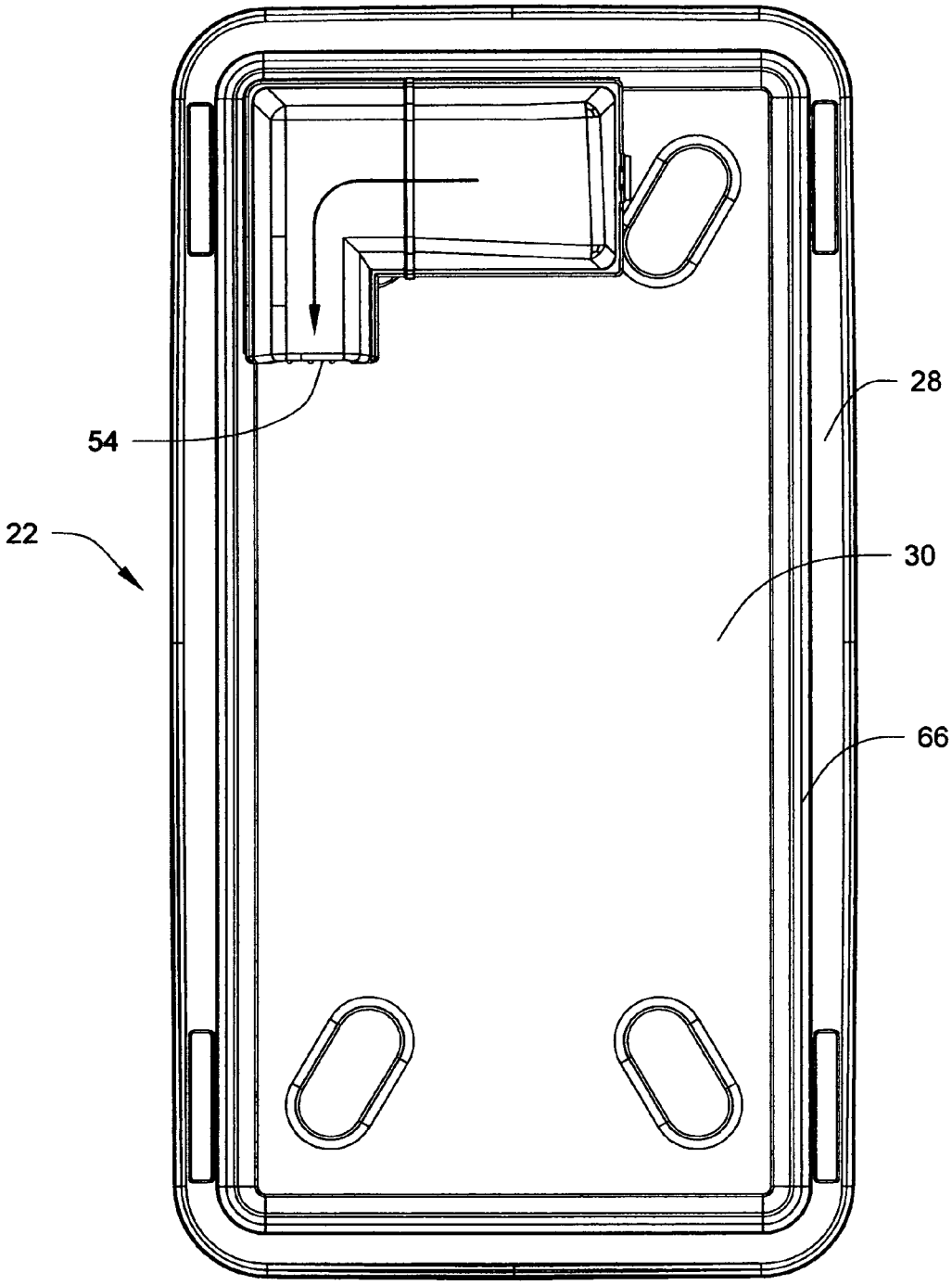
FIG. 5 is a top view of the mattress foundation of FIG. 3 with the sleep surface removed to illustrate the interior of the mattress foundation.

With reference to FIGS. 3 and 5, the fan assembly 26 is mounted inside the foundation 22, below the top edge of the side walls 28. The fan assembly 26 comprises a lower housing 38, a portion of which is disposed over the opening 32 and through which air enters the fan assembly. A fan 50 at least partially fits within the lower housing 38, and a filter cover 42 is detachably connected to the lower housing 38. A latch mechanism 44 on the filter cover 42 engages with a boss 46 on the lower housing 38 to detachably connect the filter cover 42 to the lower housing 38. The fan 50 draws air into the foundation 22 through the opening 32. The arrow in FIG. 3 indicates the direction of airflow into the foundation and to the fan.

An air filter 40 is removably disposed in the lower housing 38 to filter air that is drawn in by the fan 50. The filter 40 can be, for example, a high efficiency filter, such as a High Efficiency Particulate Air (HEPA) filter, that is preferably at least about 80% efficient at removing respirable particles at least 0.3 microns and greater in size, more preferably the filter is at least about 90% efficient at removing respirable particles at least 0.3 microns and greater in size, and most preferably the filter 40 is at least about 95% efficient at removing respirable particles at least 0.3 microns and greater in size.

A cover 52 fits onto the lower housing 38 adjacent the filter cover 42 for enclosing the fan 50 and defining with the lower housing an air outlet 54 leading to the interior space of the foundation 22. The arrow in FIG. 5 shows the direction of airflow from the filter 40 through the fan 50 and to the outlet 54.

The filter cover 42 is removable to permit access to the filter 40 for periodic replacement. Further, the fan 50 and filter 40 are completely enclosed within the interior of the fan assembly 26, and there are no openings in the top surfaces of the fan cover 52 and filter cover 42. Therefore, any fluids that may leak through the sleep surface assembly 24 are unable to enter the fan assembly 26.

Returning to FIG. 3, the sleep surface assembly 24 comprises a frame 60 that includes side frame elements 62 and corner frame elements 64. When the frame elements 62, 64 are assembled, the frame 60 is generally rectangular. When assembled, the dimensions of the frame 60 are such that the frame 60 fits around a raised lip 66 that is formed on the side walls 28 of the foundation 22 with a small gap between the lip 66 and the surrounding frame 60. In use, the sleep surface assembly 24 rests on top of the foundation 22, with the lip 66 preventing lateral shifting of the sleep surface assembly 24 off of the foundation 22. If desired, additional fastening mechanisms could be used to help retain the sleep surface on the foundation. The sleep surface assembly 24 can simply be lifted off of the foundation when access to the foundation interior or removal of the sleep surface assembly 24 is desired.

The sleep surface assembly 24 also includes a sleep surface 70 on which an infant is intended to sleep. The sleep surface 70 comprises a porous material, for example a porous fabric, that fastens into the frame 60 in a manner similar to that described for FIG. 1 and which will be described below. The material used for the sleep surface 70 is preferably washable, non-moisture absorbent, fluid pervious to permit fluids to drain into the foundation 22, and air permeable to permit air from the fan assembly 26 to be discharged upward to dissipate carbon dioxide around the infant's face.

Figure 6:
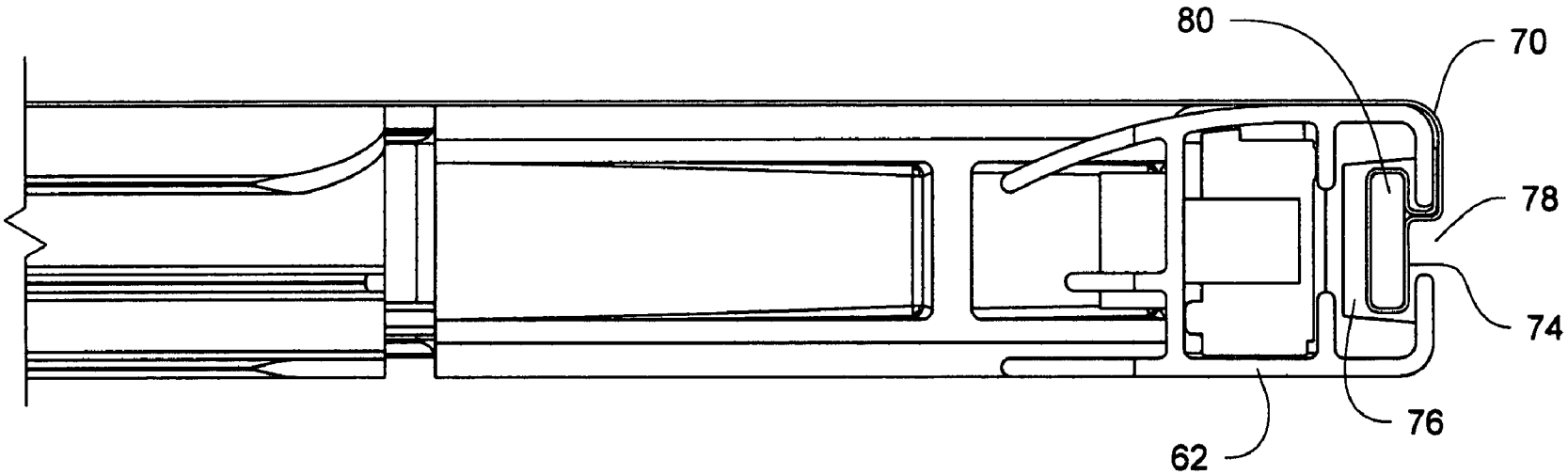
FIG. 6 is a section view through a portion of the frame of the sleep surface assembly.

With reference to FIGS. 3 and 6, the sleep surface is sized such that the edges thereof overhang the side frame elements 62. A pocket 74 is formed on each of the overhanging edges of the sleep surface 70. The side frame elements 62 each have a channel 76 with an outward facing slot 78. The edges of the sleep surface 70 are disposed in the channels 76 and dowels 80 are inserted into the pockets 74 to retain the edges of the sleep surface 70 in the channels 76.

Figure 7:
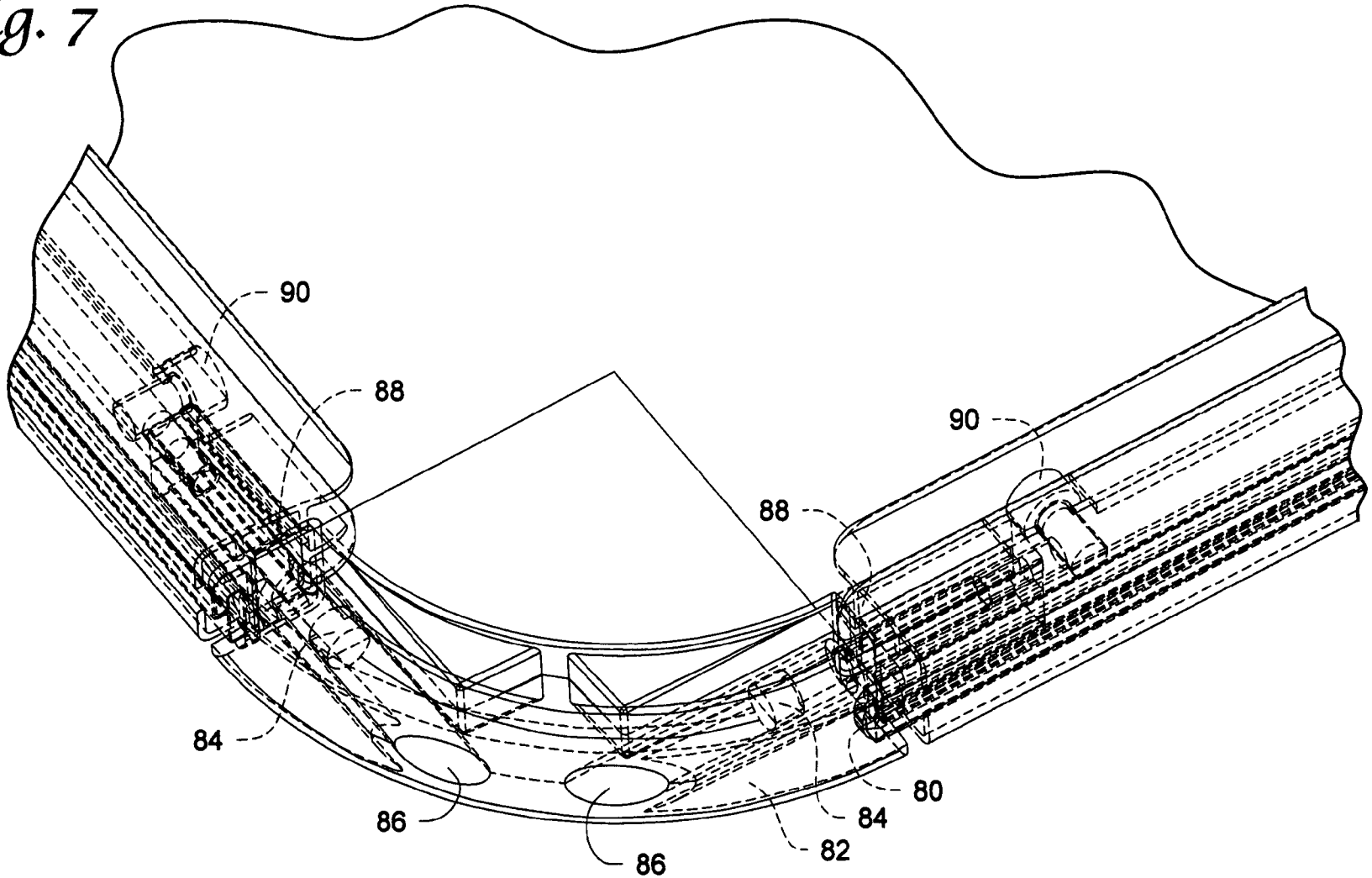
FIG. 7 illustrates a corner of the sleep surface assembly illustrating the tension adjustment mechanism.
Figure 8:
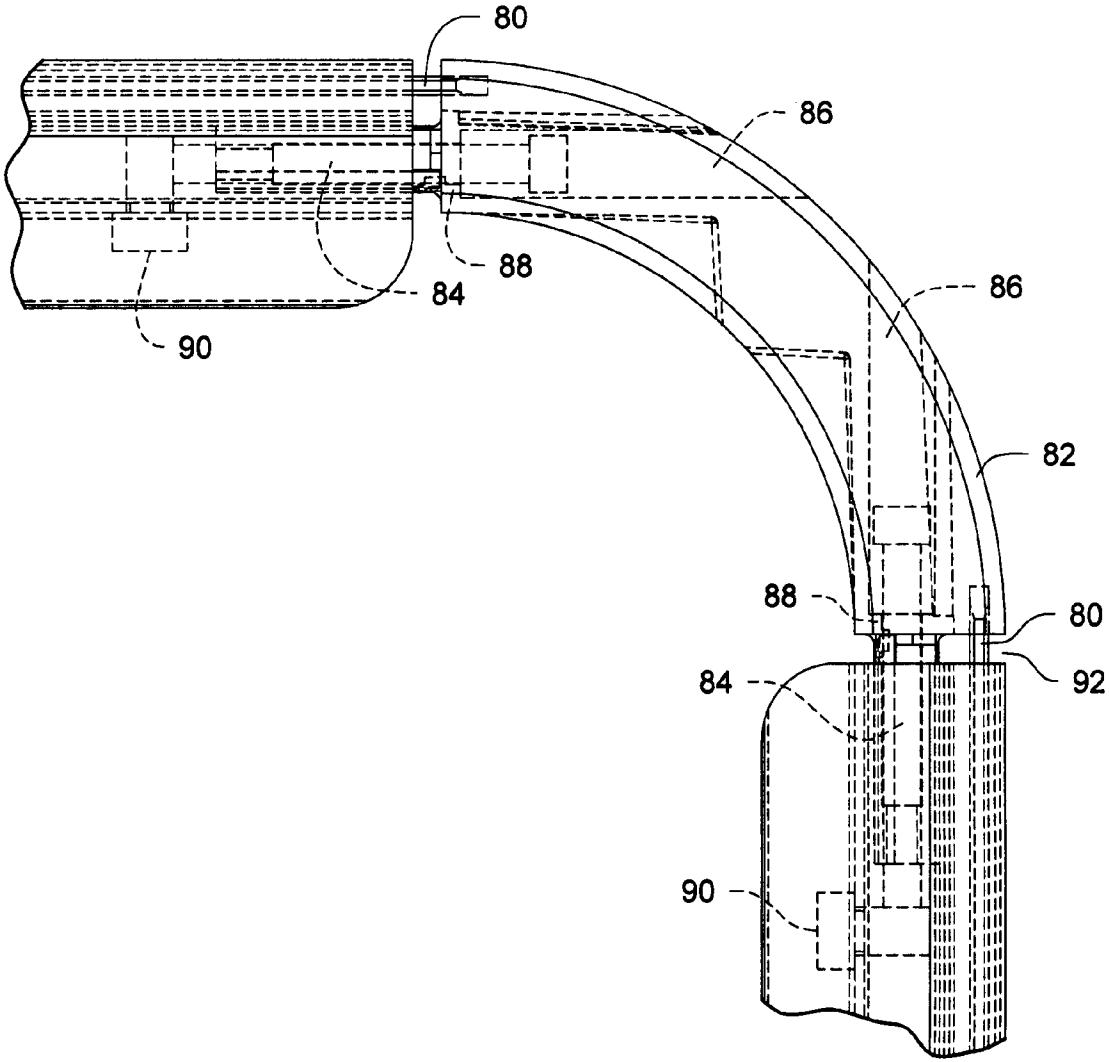
FIG. 8 is a top view of the tension adjustment mechanism of FIG. 7.

With reference to FIGS. 3, 7 and 8, the dowels 80 are inserted into each channel 76 via slots 82 that are formed in the corner frame elements 64. When the frame 60 is assembled, the slots 82 are aligned with the channels 76 thereby allowing the dowels to be slid into the channels 76. As indicated above in the discussion of FIG. 1, varying the size of the dowels 80, or rotating the dowels 80 in the channels 76, would allow the tension of the sleep surface 70 to be adjusted.

The crib mattress 20 is provided with an alternative sleep surface tensioning mechanism. Referring to FIGS. 3, 7 and 8, the tensioning mechanism comprises a system that is designed to adjust the distance between the ends of the corner frame elements 64 and the side frame elements 62. Due to the close fit between the corner frame elements 64 and the side frame elements 62, movement of the corner frame elements 64 makes the "rectangle" formed by the corner frame elements 64 and the side frame elements 62 bigger, thereby changing the tension on the sleep surface 70.

The tensioning mechanism illustrated in FIGS. 3, 7 and 8 comprises threaded members 84, for example bolts, that are disposed in channels 86 formed in the corner frame elements 64. The ends 88 of the channels 86 are threaded. A fixed member 90, for example a bolt or a block of rigid material, is fixed in each side frame member 62. The threaded members 84 and fixed members 90 are sized and positioned such that the end of each threaded member 84 engages against a fixed member 90 as shown in FIGS. 7 and 8.

By turning each threaded member 84 one way or another, the threaded members either advance toward, or retreat from, the fixed members 90. When a threaded member 84 is advanced toward a fixed member 90, the engagement between the two forces the corner frame element 64 away from the corresponding side frame element 62, which increases the gap 92 between the two effectively lengthening one side of the rectangle. This increases the tension on the corner frame piece 64 and the side frame elements 62 changing the tension of the sleep surface 70. Suitable adjustment of all the threaded members 84 is used to create the desired tension on the sleep surface.

The tensioning mechanism permits the firmness of the sleep surface 70 to be adjusted. Further, an infant cannot become entangled in the sleep surface 70 and the sleep surface 70 will not create pockets that would permit the accumulation of carbon dioxide. Moreover, the hollow interior of the foundation means less obstruction to airflow within the mattress so that air is dispersed more uniformly across the porous sleep surface.

The invention claimed is:

1. A ventilated mattress, comprising:

a mattress foundation having a generally hollow interior and an air inlet;

a fan assembly disposed within the hollow interior of the mattress foundation for drawing air into the hollow interior of the mattress foundation through the air inlet;

a sleep surface assembly that is sized and configured to be supported by the mattress foundation, the sleep surface assembly includes a frame and a sleep surface that is connected to the frame in a manner to permit the tension of the sleep surface to be adjusted, and wherein the sleep surface is porous;

wherein the mattress foundation includes a bottom wall and the air inlet is formed in the bottom wall; and further comprising feet connected to the bottom wall for spacing the bottom wall from the ground.

2. The ventilated mattress of claim 1, wherein the sleep surface is formed of a material that is washable, non-moisture absorbent, fluid pervious, and air permeable.

3. The ventilated mattress of claim 1, wherein the sleep surface assembly rests on the mattress foundation and is not fastened to the mattress foundation by mechanical fasteners.

4. The ventilated mattress of claim 1, wherein the fan assembly comprises a fan and a filter.

5. The ventilated mattress of claim 4, wherein the filter is a high efficiency filter.

6. A ventilated mattress, comprising:

a mattress foundation having a generally hollow interior and an air inlet;

a fan assembly disposed within the hollow interior of the mattress foundation for drawing air into the hollow interior of the mattress foundation through the air inlet; and a sleep surface assembly that is sized and configured to be supported by the mattress foundation, the sleep surface assembly includes a frame and a sleep surface that is connected to the frame in a manner to permit the tension of the sleep surface to be adjusted, and wherein the sleep surface is porous;

wherein the mattress foundation includes a bottom wall and the air inlet is formed in the bottom wall; and wherein the bottom wall includes corners, and further comprising a cleat at each corner.

7. The ventilated mattress of claim 6, wherein the sleep surface is formed of a material that is washable, non-moisture absorbent, fluid pervious, and air permeable.

8. The ventilated mattress of claim 6, wherein the sleep surface assembly rests on the mattress foundation and is not fastened to the mattress foundation by mechanical fasteners.

9. A ventilated mattress, comprising:

a mattress foundation having a generally hollow interior and an air inlet;

a fan assembly disposed within the hollow interior of the mattress foundation for drawing air into the hollow interior of the mattress foundation through the air inlet; and a sleep surface assembly that is sized and configured to be supported by the mattress foundation, the sleep surface assembly includes a frame and a sleep surface that is connected to the frame in a manner to permit the tension of the sleep surface to be adjusted, and wherein the sleep surface is porous;

wherein the mattress foundation includes side walls and a lip formed on the side walls, the frame has an inside perimeter, and wherein the frame is configured such that the perimeter of the frame fits around the lip, whereby the lip limits lateral shifting of the frame on the mattress foundation.

10. The ventilated mattress of claim 9, wherein the mattress foundation includes a bottom wall and the air inlet is formed in the bottom wall.

11. The ventilated mattress of claim 9, wherein the sleep surface is formed of a material that is washable, non-moisture absorbent, fluid pervious, and air permeable.

12. The ventilated mattress of claim 9, wherein the sleep surface assembly rests on the mattress foundation and is not fastened to the mattress foundation by mechanical fasteners.

13. A ventilated mattress, comprising:

a mattress foundation having a generally hollow interior and an air inlet;

a fan assembly disposed within the hollow interior of the mattress foundation for drawing air into the hollow interior of the mattress foundation through the air inlet; and a sleep surface assembly that is sized and configured to be supported by the mattress foundation, the sleep surface assembly includes a frame and a sleep surface that is connected to the frame in a manner to permit the tension of the sleep surface to be adjusted, and wherein the sleep surface is porous;

wherein the frame is rectangular, the sleep surface includes edges that overhang the frame, and a pocket is formed on each of the overhanging edges of the sleep surface.

14. The ventilated mattress of claim 13, wherein the frame comprises side frame elements and corner frame elements, a channel and an outward facing slot are formed in each of the side frame elements and the corner frame elements, and the pockets of the overhanging edges of the sleep surface are disposed in the channels.

15. The ventilated mattress of claim 14, further comprising dowels inserted into the pockets within the channels to retain the edges of the sleep surface in the channels.

16. The ventilated mattress of claim 13, wherein the mattress foundation includes a bottom wall and the air inlet is formed in the bottom wall.

17. A ventilated mattress, comprising:

a mattress foundation having a generally hollow interior and an air inlet;

a fan assembly disposed within the hollow interior of the mattress foundation for drawing air into the hollow interior of the mattress foundation through the air inlet; and a sleep surface assembly that is sized and configured to be supported by the mattress foundation, the sleep surface assembly includes a frame and a sleep surface that is connected to the frame in a manner to permit the tension of the sleep surface to be adjusted, and wherein the sleep surface is porous;

wherein the frame includes a perimeter length, and further comprising a mechanism for altering the perimeter length.

18. The ventilated mattress of claim 17, wherein the frame comprises frame elements, and the mechanism for altering the perimeter length comprises means for changing the distance between adjacent frame elements.

19. The ventilated mattress of claim 17, wherein the frame is generally rectangular and includes opposed pairs of frame elements, and the sleep surface is stretched taut between the opposed pairs of frame elements.

20. The ventilated mattress of claim 17, wherein the mattress foundation includes a bottom wall and the air inlet is formed in the bottom wall.

* * * * *